US009873193B2

(12) United States Patent
Gorenflo et al.

(10) Patent No.: US 9,873,193 B2
(45) Date of Patent: Jan. 23, 2018

(54) METHOD FOR OPERATING A HANDHELD WORK APPARATUS HAVING A COMBUSTION ENGINE

(71) Applicant: Andreas Stihl AG & Co. KG, Waiblingen (DE)

(72) Inventors: Ernst Gorenflo, Bad Rappenau (DE); Klaus-Martin Uhl, Plochingen (DE); Georg Maier, Kernen im Remstal (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 466 days.

(21) Appl. No.: 14/569,866

(22) Filed: Dec. 15, 2014

(65) Prior Publication Data

US 2015/0174751 A1 Jun. 25, 2015

(30) Foreign Application Priority Data

Dec. 21, 2013 (DE) ..... 10 2013 021 832

(51) Int. Cl.
*B25F 5/00* (2006.01)
*B27B 17/08* (2006.01)
(Continued)

(52) U.S. Cl.
CPC ..... *B25F 5/00* (2013.01); *B27B 17/08* (2013.01); *F02D 29/00* (2013.01); *F02D 41/022* (2013.01);
(Continued)

(58) Field of Classification Search
CPC .. B25F 5/00; B27B 17/08; F02D 39/00; F02P 5/02
(Continued)

(56) References Cited

U.S. PATENT DOCUMENTS 4,979,477 A * 12/1990 Nickel ..... F02B 63/02 123/335
5,447,131 A 9/1995 Nickel et al.
(Continued)

FOREIGN PATENT DOCUMENTS

DE 100 24 704 A1 11/2001

*Primary Examiner* — Nathaniel Chukwurah
(74) *Attorney, Agent, or Firm* — Walter Ottesen, P.A.

(57) ABSTRACT

A handheld work apparatus has a combustion engine which drives a tool of the work apparatus via a centrifugal clutch. The centrifugal clutch couples in an engagement rotational speed range ($n_K$) which extends between a lower engagement rotational speed ($n_u$) and an upper engagement rotational speed ($n_o$). The engine has a fuel supply device, an ignition device, a control device and a device for detecting the rotational speed (n) of the engine. A method for operating the handheld work apparatus makes provision for the rotational speed profile of the combustion engine to be monitored in the engagement rotational speed range ($n_K$) and for the power (P) output for driving the tool to be increased from an operating power ($P_1$) to an increased power ($P_2$, $P_3$) when the rotational speed profile corresponds with a predetermined rotational speed profile over a predetermined period of time (Δt).

18 Claims, 3 Drawing Sheets

(51) Int. Cl.

| | |
|---|---|
| ***F02D 29/00*** | (2006.01) |
| ***F02D 41/02*** | (2006.01) |
| ***F02D 41/14*** | (2006.01) |
| *F02D 41/30* | (2006.01) |
| *F02P 5/04* | (2006.01) |
| *F02P 5/15* | (2006.01) |
| *F02D 37/02* | (2006.01) |
| *F02D 41/00* | (2006.01) |
| *F02M 1/02* | (2006.01) |

(52) U.S. Cl.
CPC ..... *F02D 41/1497* (2013.01); *F02D 37/02* (2013.01); *F02D 41/0002* (2013.01); *F02D 41/30* (2013.01); *F02D 2200/021* (2013.01); *F02D 2200/101* (2013.01); *F02D 2200/1006* (2013.01); *F02D 2250/18* (2013.01); *F02D 2400/06* (2013.01); *F02M 1/02* (2013.01); *F02P 5/045* (2013.01); *F02P 5/1504* (2013.01)

(58) Field of Classification Search
USPC ..... 173/1, 2; 123/406.52, 339.11
See application file for complete search history.

(56) References Cited

U.S. PATENT DOCUMENTS

| | | | | |
|---|---|---|---|---|
| 6,976,472 | B2 * | 12/2005 | Nickel | F02D 41/045 123/406.25 |
| 2006/0086337 | A1 | 4/2006 | Nickel | |
| 2011/0030980 | A1 * | 2/2011 | Ho | B23B 45/008 173/1 |
| 2012/0193112 | A1 * | 8/2012 | Gwosdz | F02D 31/009 173/1 |
| 2012/0297631 | A1 | 11/2012 | Kunert et al. | |

* cited by examiner

METHOD FOR OPERATING A HANDHELD WORK APPARATUS HAVING A COMBUSTION ENGINE

CROSS REFERENCE TO RELATED APPLICATION

This application claims priority of German patent application no. 10 2013 021 832.2, filed Dec. 21, 2013, the entire content of which is incorporated herein by reference.

BACKGROUND OF THE INVENTION

United States patent application publication 2012/0297631 discloses a method for operating a handheld work apparatus having a combustion engine. The combustion engine drives a tool via a clutch. The clutch engages in a speed range between a lower and an upper engagement speed.

In the case of handheld work apparatus of this type, the tool may stop under full load during operation, for example if a tooth of a saw chain intermeshes and locks in the material to be cut. This results in a drop in speed of the combustion engine to the engagement speed range. If the tool is stationary, that is, blocked, the clutch may be damaged in the engagement speed range. In order to avoid damage to the clutch, U.S. Pat. No. 5,447,131 makes provision to reduce the speed of the combustion engine if the speed is operated for too long a period within a critical speed range.

SUMMARY OF THE INVENTION

It is an object of the invention to provide a method for operating a handheld work apparatus having a combustion engine. The method makes it easier for the operator to work with the work apparatus.

The method of the invention is for operating a handheld work apparatus which includes a centrifugal clutch, a work tool and a combustion engine for driving the work tool via the centrifugal clutch, the centrifugal clutch defining a coupling engaging rotational speed range ($n_K$) wherein the centrifugal clutch engages and the coupling engaging range extending between a lower coupling engaging rotational speed ($n_u$) and an upper coupling engaging rotational speed ($n_o$); the combustion engine including a fuel metering device, an ignition device, a control unit and a device for detecting the rotational speed (n) of the combustion engine. The method includes the steps of: monitoring the rotational speed profile of the combustion engine in the coupling engaging rotational speed range ($n_K$); and, increasing the power (P) delivered to drive the work tool from an operating power ($P_1$) to an increased power ($P_2$, $P_3$) when the rotational speed profile corresponds to a pregiven rotational speed profile over a pregiven time span ($\Delta t$).

Provision is made to increase the power, which is output for driving the tool, from an operating power to an increased power if a speed profile of the combustion engine in the engagement speed range corresponds to a predetermined speed profile for a predetermined period. By evaluation of the speed profile in the engagement speed range, a determination can be made as to whether the tool is locked in the engagement speed range, such that no further acceleration of the tool is possible. By increasing the power, it can be attempted to break the tool loose such that the speed can rise again. Owing to the fact that the power increase takes place only when the speed profile corresponds to the predetermined speed profile, an increase in power, which would lead to increased temperatures and increased wear during continuous operation, is also acceptable. If the increased power is sufficient in order to break the tool loose, the operator can continue to work without interruption.

The power output by the combustion engine for driving the tool is preferably increased. However, it can alternatively or additionally be provided to switch on a further energy source for driving the tool.

The predetermined speed profile is advantageously a constant speed profile. If the speed in the engagement speed range remains constant for a predetermined period, this can be evaluated as an indication of the fact that the tool cannot move, since the operator customarily opens the throttle in the engagement speed range, and therefore the speed rapidly rises in the engagement speed range and the clutch rapidly engages. The constant speed here is a substantially constant speed. In the case of a combustion engine, speed fluctuations occur within an engine cycle due to the design. Furthermore, in particular in the case of two-stroke engines, functionally induced fluctuations in the speed also occur to a certain extent over a plurality of cycles, in particular due to the efficiency of the combustion differing and due to combustion misfires, which interfere with the speed which is constant per se. A constant speed is present if the speed during an engine cycle and over a plurality of engine cycles fluctuates merely within the customary speed fluctuations and the rapid rise in speed customary for the engagement speed range does not take place. The predetermined period is advantageously at least approximately 0.1 s, in particular at least approximately 0.3 s, preferably at least approximately 0.5 s. As a result, a non-moving tool can be reliably detected. A very reliable detection of the non-moving tool is made possible if the predetermined period is at least approximately 1 s. The predetermined period is advantageously less than approximately 30 s, in particular less than approximately 10 s, preferably less than approximately 5 s. The predetermined speed profile can also be, for example, a slightly rising or dropping speed. A slightly changing speed may be produced, for example, due to heating as the clutch slips.

The increased power is advantageously 103%, in particular at least 105% of the operating power. In many cases, it can thereby be possible to break a sticking tool free. The increased power is in particular at maximum 120%, preferably at maximum 110%, of the operating power. This makes it possible to avoid excessive heating of the engine and excessive wear during the operation at increased power. A further increase in power can be achieved, for example, by a further drive motor, in particular an electric motor, preferably the electric motor of an electric starting device for the combustion engine, being switched on. The increased power which is achievable with the further drive motor for driving the tool can be, for example, approximately 150% to approximately 250% of the operating power.

The power is in particular increased abruptly to the increased power. The tool is thereby particularly effectively broken loose. Provision may be made for the power to be reduced at least once and increased again after the increase in power. After the increase in power, the power is advantageously repeatedly reduced and increased in short, consecutive intervals of time. In particular, the power fluctuates at an increased level. As a result, this can improve the effect of breaking the tool loose. In addition, the operator receives feedback about the fact that the tool is stuck, and can react appropriately, for example can reduce the feed force.

The power is advantageously reset to the operating power when the speed leaves the engagement speed range. This avoids an increased power during the customary operation. The operating power here is the power which arises at a certain speed and load when the gas throttle is correspondingly actuated. The operating power varies here depending on speed and load, and therefore the absolute power value after the resetting of the power can differ from the power value before the increasing of the power. For the resetting to the operating power, the operating parameter, which has been adjusted in order to increase the power, is advantageously restored to the starting value thereof before the increase in the power. Provision may also be made to define an operating parameter on the basis of a curve, for example, depending on the speed, and for the operating parameter for the increase in power to be changed by a fixed value or to be determined with reference to a second curve which is assigned to an increased power.

In order to avoid excessive loading of the combustion engine because of the increased power, provision is made for the power to be reset to the operating power after a predetermined time has expired. The predetermined time can be, for example, approximately 0.1 s to approximately 60 s. The predetermined time is advantageously approximately 0.5 s to approximately 30 s, in particular approximately 1 s to approximately 10 s. Periods of differing length can be predetermined here for different areas of use. Alternatively or in addition, provision may be made for the power to be reset to the operating power after a predetermined temperature of the combustion engine is reached. The criteria for resetting the power to the operating power are advantageously selected in such a manner that damage to the combustion engine because of the brief operation at increased power is avoided. Provision may be made to provide a plurality of criteria for the resetting of the power and to reset the power to the operating power as soon as one of the criteria is met.

If the power for driving the tool is increased by switching on a further drive motor, it is provided that the predetermined time is up to approximately 10 s. The predetermined time during which the further drive motor increases the power output for driving the tool is advantageously at least approximately 5 s.

In order to increase the power emanating from the combustion engine, an adjustment of the ignition time of the combustion engine can be provided. The ignition time is adjusted in particular to "early" in order to increase the power. Additionally or alternatively, provision may be made for the power to be increased by changing the quantity of fuel supplied. The quantity of fuel supplied is in particular reduced here; that is to say, the engine is leaned. This is provided in particular whenever the engine is operated within the rich mix range. However, provision may also be made to increase the supplied quantity of fuel in order to increase the power, that is to say to run the combustion engine at a slightly richer mix. This is preferably provided whenever the combustion engine is operated in the lean range. Alternatively or in addition, provision may also be made to increase the output power by changing the quantity of combustion air supplied to the combustion engine. The quantity of combustion air is in particular increased here such that the mixture supplied to the combustion engine is leaned. In order to increase the power output by the combustion engine, provision may also be made to change the supplied quantity of fuel/air mixture, in particular to increase the quantity, for example by supplying a fuel/air mixture via an additional mixture path. The individual measures for increasing the power output by the combustion engine can be used here individually or in any combination.

Provision may be made for the combustion engine to supply at least one further energy consumer with energy, in addition to supplying the tool with energy. In order to increase the power, provision can be made in particular for the at least one further consumer to be switched off. It may also be advantageous for the power to be increased by reducing the energy supplied to the at least one further consumer. Further consumers can be, for example, a generator or an oil pump for delivering lubricating oil to the tool. Other consumers can also be provided. The consumers can consume mechanical energy provided by the combustion engine or electrical energy generated by the combustion engine.

The work apparatus advantageously has a further drive motor, and the power output for driving the tool is increased by switching on the further drive motor. The further drive motor is in particular an electric motor. With an electric motor, a significant increase in power can briefly be achieved in a simple manner. The drive motor is preferably an electric motor which is present in any case, in particular the electric motor of an electric starter of the work apparatus.

The work apparatus advantageously has an operating element, and the power of the combustion engine is increased when the operating element is actuated. The operator can thereby trigger a brief increase in power. The increase in power takes place here in particular in the engagement speed range. However, a brief increase in power outside the engagement speed range may also be advantageous.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
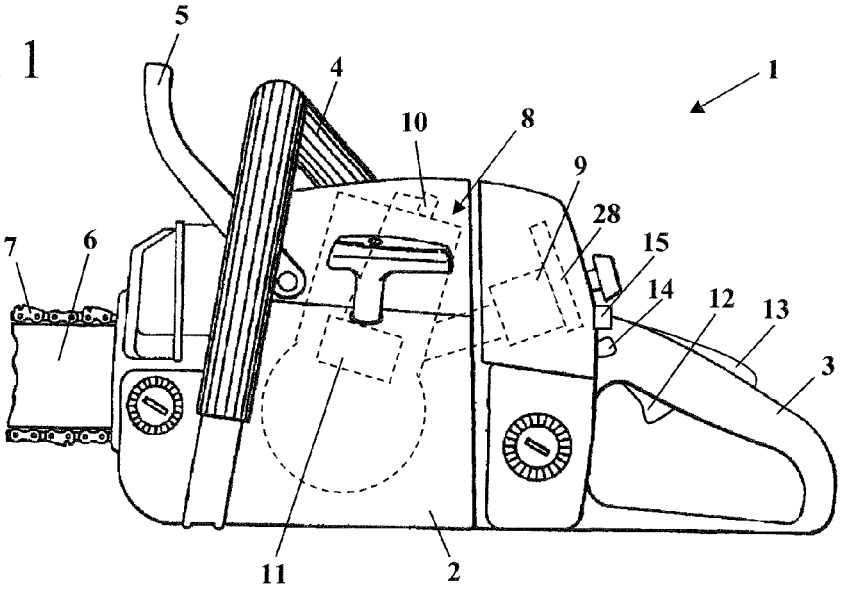
FIG. 1 is a schematic of a motor-driven saw.

FIG. 1 schematically shows a motor-driven saw 1 of an embodiment of a handheld work apparatus. However, the present invention can also be provided in the case of other handheld work apparatuses, such as, for example, cut-off machines, stone cutters, hedge shears or the like. The motor-driven saw 1 has a housing 2, a rear handle 3 and a bale handle 4. A guide bar 6, on which a saw chain 7 is arranged in a revolving manner, is fixed to the housing 2. A hand guard 5 which can serve at the same time for triggering a chain brake (not shown) is arranged on that side of the bale handle 4 which faces the guide bar 6.

A combustion engine 8 arranged in the housing 2 serves for driving the saw chain 7. The combustion engine 8 is a single-cylinder engine, advantageously a mixture-lubricated engine, such as a two-stroke engine, or a mixture-lubricated four-stroke engine. The combustion engine 8 draws in combustion air via an air filter 28 and a carburetor 9. A fuel valve which supplies the fuel directly into the combustion engine 8 can also be provided instead of the carburetor 9. The combustion engine 8 has a spark plug 10 which is supplied with electrical power by an ignition module 11.

A throttle lever 12, which is mounted pivotably on the rear handle 3, is provided for operating the combustion engine 8. In addition, a throttle lever lock 13, which prevents an unintentional actuation of the throttle lever 12, is mounted pivotably on the rear handle 3. An operating mode selector 14 is arranged on the housing 2 adjacent to the rear handle 3. The operating mode selector 14 advantageously serves for setting at least one starting position of the combustion engine 8 and for switching off the combustion engine 8. In addition, the motor-driven saw 1 has an operating element 15 which, in the embodiment, is arranged adjacent to the operating mode selector 14 and the function of which is also explained in more detail below.

Figure 2:
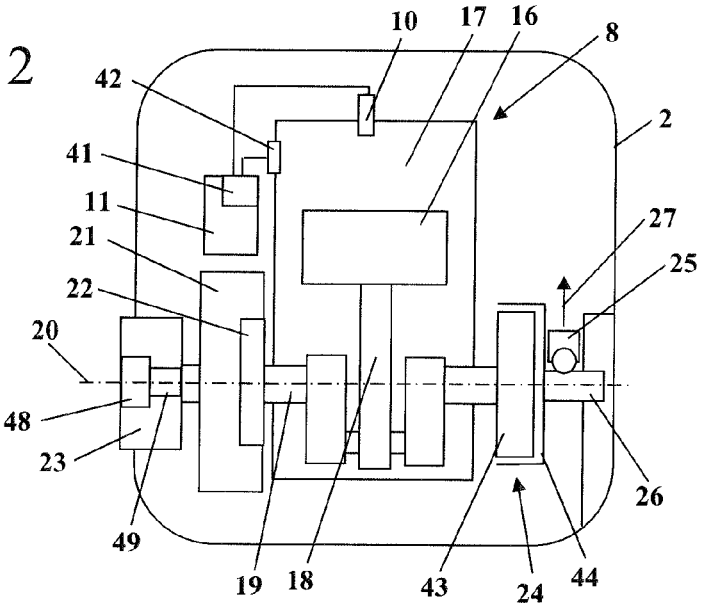
FIG. 2 is a schematic section through the motor-driven saw from FIG. 1.

As FIG. 2 shows, the spark plug 10 protrudes into a combustion space 17 of the combustion engine 8. The combustion space 17 is bounded by a piston 16 which drives a crankshaft 19 in a rotating manner via a connecting rod 18. The crankshaft 19 is driven in a rotating manner about an axis of rotation 20. A flywheel 21 which can be, for example, a fan wheel is fixed to the crankshaft 19. The flywheel 21 has magnets (not shown) which, at the ignition module 11, induce a voltage which serves for generating the ignition spark at the spark plug 10. In the embodiment, a generator 22 is also fixed to the crankshaft 19, the generator serving to generate electrical energy. In the embodiment, the generator 22 is arranged in the region of the flywheel 21. However, a different arrangement may also be advantageous. A starter 23 for starting the combustion engine 8 is arranged on that side of the flywheel 21 which faces away from the combustion engine 8. In the embodiment, the starter 23 is an electric starter which comprises a drive motor 48. The starter 23 has a coupling device 49 via which the drive motor 48 acts on the crankshaft 19. However, the starter 23 may also be a starter which can be actuated manually, for example a pull-rope starter.

A centrifugal clutch 24 is arranged on that side of the combustion engine 8 which is opposite the flywheel 21. The drive part 43 of the centrifugal clutch 24 is connected to the crankshaft 19 for rotation therewith. The drive part 43 advantageously comprises one or more centrifugal weights which are mounted so as to be pivotable radially outward with respect to the axis of rotation 20 and in a spring-loaded manner. The output part 44 is configured as a clutch drum which is connected to a drive pinion 26 for rotation therewith. The drive pinion 26 drives the saw chain 7 (not shown in FIG. 2). In addition, the output part 44 drives an oil pump 25 (shown schematically in FIG. 2) which serves for delivering lubricating oil for the saw chain 7.

As FIG. 2 schematically shows, the combustion engine 8 has a temperature sensor 42. In the embodiment, the temperature sensor 42 is arranged adjacent to the combustion space 17. However, a different arrangement may also be advantageous. The temperature sensor 42 can be arranged, for example, on a crankcase of the combustion engine 8. The combustion engine 8 has a control device 41 which, in the embodiment, is integrated on the ignition module 11. However, a separate configuration of the control device 41 may also be advantageous. The temperature sensor 42 is connected to the control device 41. In order to detect the speed of the combustion engine 8, the control device 41 advantageously evaluates the signal of the voltage induced at the voltage module 11. However, a separate speed sensor may also be advantageous. A signal of the generator 22 can also be evaluated in order to determine the speed of the combustion engine 8.

Figure 3:
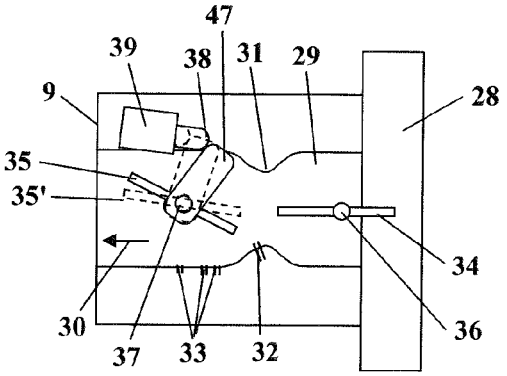
FIG. 3 is a schematic of the carburetor of the motor-driven saw from FIG. 1.

FIG. 3 schematically shows the carburetor 9 and the air filter 28. Combustion air is drawn in by the combustion engine 8 in a flow direction 30 by the air filter 28 and an intake channel 29 formed in the carburetor 9. A choke flap 34 with a choke shaft 36 is mounted pivotably in the intake channel 29. A throttle flap 35 with a throttle shaft 37 is mounted pivotably downstream of the choke flap 34 with respect to the flow direction 30. A different configuration of a throttle element and of a choke element may also be advantageous. The choke element may also be omitted. A venturi 31 is formed in the intake channel 29. A main fuel opening 32 leads into the intake channel 29 in the region of the venturi 31. A plurality of secondary fuel openings 33 lead into the intake channel 29 downstream of the main fuel opening 32. The fuel openings 32 and 33 can be fed by a fuel-filled control space of the carburetor 9. The carburetor 9 is advantageously a diaphragm-type carburetor which supplies the fuel depending on the negative pressure in the intake channel 29 and depending on a reference pressure. However, provision may also be made for the fuel openings 32 and 33 to be fed via a fuel valve, for example a solenoid valve. Provision may also be made for the fuel not to be supplied via a carburetor 9, but rather directly into the combustion engine 8, for example via one or more fuel valves. The fuel can be supplied here, for example, into the combustion space 17 or into a crank case of the combustion engine 8.

In order to control the quantity of fuel supplied, the throttle flap 35 is mounted pivotably. The completely open position of the throttle flap 35 is defined by an end stop 38 which interacts with a lever 47 (shown schematically in FIG. 3) which is connected to the throttle shaft 37 for rotation therewith. The lever 47 and the end stop 38 are arranged outside the intake channel 29, advantageously on the outside of a housing of the carburetor 9.

The throttle lever 12 advantageously acts on the throttle flap 35. When the throttle lever 12 is fully actuated, the lever 47 bears against the end stop 38. As indicated schematically by the dashed line in FIG. 3, the end stop 38 is adjustable via an actuator 39. If the actuator 39 is actuated, the throttle flap can be adjusted, for example, into the position 35' shown by a dashed line in FIG. 3. By actuation of the actuator 39, the quantity of combustion air supplied to the combustion engine 8 can be increased when the throttle lever 12 is fully actuated.

Figure 4:
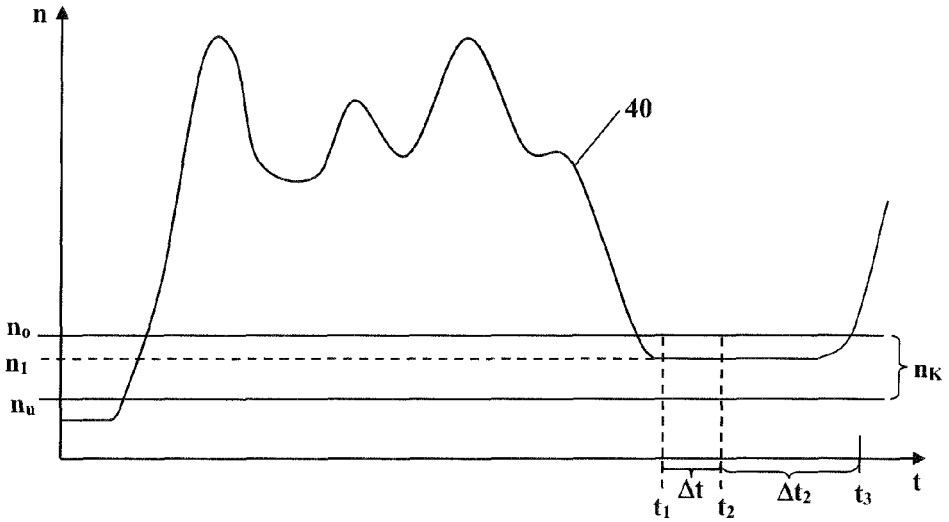
FIG. 4 is a diagram which indicates, by way of example, the profile of the rotational speed of the combustion engine of the motor-driven saw from FIG. 1 over time.

FIG. 4 schematically shows, by means of a curve 40, a possible profile of the speed (n) of the combustion engine 8 over time (t). The speed (n) initially rises sharply. In the process, the speed (n) runs continuously through an engagement speed range $n_K$ which extends from a lower engagement speed $n_u$ to an upper engagement speed $n_o$. When the lower engagement speed $n_u$ is reached, the at least one centrifugal weight of the drive part 43 is placed against the clutch drum of the output part 44. Until the upper engagement speed $n_o$ is reached, the centrifugal weight is pressed with increasing force against the clutch drum. As a result, when the speed of the drive part 43 increases, the power transmittable via the centrifugal clutch 24 rises. The curve 40 shows the speed profile (n) when the throttle lever 12 is fully actuated. The fluctuations in the speed (n) arise due to a different load, for example if the feed differs, that is, if the operator presses the motor-driven saw 1 more or less strongly into the workpiece to be cut. At the time $t_1$, the speed (n) has dropped under the upper engagement speed $n_o$ to a speed $n_1$. The speed remains constant after the speed $n_1$ has been reached.

The control device 41 monitors the profile of the speed (n) in the engagement speed range $n_K$ and recognizes that the speed $n_1$ remains constant over a period of time Δt up to a predetermined second time $t_2$. Speed fluctuations which, in the case of a combustion engine, occur within an engine cycle and over a plurality of engine cycles due to the design are not taken into consideration in the determination of the constant speed profile. The period of time here is advantageously at least 0.1 s, in particular at least 0.3 s, preferably at least 0.5 s. The period of time Δt is advantageously less than approximately 30 s, in particular less than approximately 10 s, preferably less than approximately 5 s. After the predetermined period of time Δt has elapsed, the control device 41 takes measures for briefly increasing the power output by the combustion engine 8 for driving the saw chain 7. As a result, the speed of the drive part 43 is increased, and the at least one centrifugal weight is pressed outward with greater force. By this means, the frictional force in effect is increased and therefore the power available for driving the saw chain 7 rises.

Figure 5:
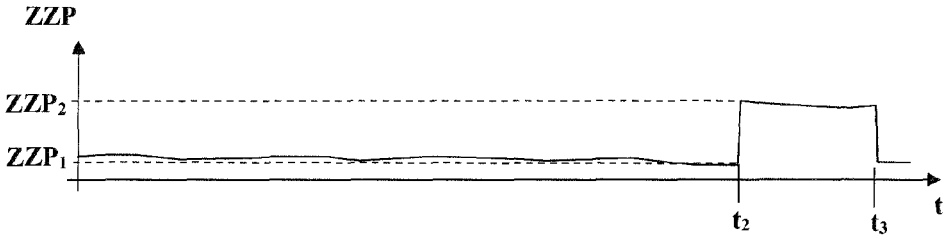
FIG. 5 is a diagram which schematically indicates a possible profile of the ignition time over time.
Figure 8:
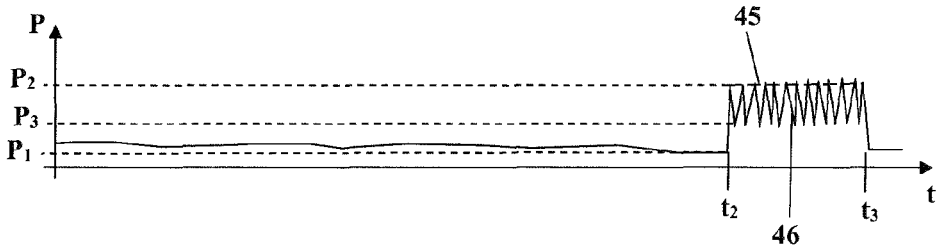
FIG. 8 is a diagram which schematically indicates possible profiles of the power of the combustion engine over time; and, FIG. 9 is a diagram which schematically indicates a further possible profile of the ignition time over time.

In order to increase the power, it is possible, for example, for the ignition time ZZP to be adjusted. A possible profile of the ignition time is illustrated schematically in FIG. 5. Up to the ignition time $ZZP_2$, the ignition time ZZP is subject to only small fluctuations. The ignition time ZZP may also be constant. At the time $t_2$, that is, after the speed (n) has been constant for a period of time Δt, the ignition time is abruptly adjusted from an ignition time $ZZP_1$ to an ignition time $ZZP_2$. The ignition time $ZZP_2$ is advantageously significantly earlier than the ignition time $ZZP_1$. The ignition time $ZZP_2$ can be located, for example, approximately 10° crankshaft angle before the first ignition time $ZZP_1$. The ignition time $ZZP_2$ is located here closer to the power-optimum ignition time than the ignition time $ZZP_1$. By adjusting the ignition time from the first ignition time $ZZP_1$ to the second ignition time $ZZP_2$, the power output by the combustion engine 8 is increased. This is shown schematically in FIG. 8.

At the second time $t_2$, the power P output by the combustion engine corresponded to an operating power $P_1$. Upon adjustment of the ignition time from the ignition time $ZZP_1$ to the ignition time $ZZP_2$ to "advanced", the power has abruptly increased to an increased power $P_2$. As indicated by the line 45 in FIG. 8, the increased power $P_2$ remains approximately constant as far as a third time $t_3$. As FIG. 4 shows, the speed increases again above the upper engagement speed $n_o$ before the third time $t_3$ is reached. The power P can advantageously be reset to the operating power $P_1$ when the speed (n) leaves the engagement speed range $n_K$. However, it may also be advantageous to reset the power P to the operating power $P_1$ after a predetermined time $\Delta t_2$ has elapsed. The predetermined time $\Delta t_2$ can advantageously be from approximately 0.1 s to approximately 60 s, in particularly from approximately 0.5 s to approximately 30 s, preferably from approximately 1 s to approximately 10 s. The power P can alternatively be reset to the operating power $P_1$ if the temperature of the combustion engine 8, which temperature is determined by the temperature sensor 42, reaches a predetermined value. The power is reset from the increased power $P_2$ to the operating power $P_1$ at the third time $t_3$. In an advantageous manner, a plurality of criteria for the resetting of the power to the operating power $P_1$ are monitored and the power is reset to the operating power $P_1$ as soon as one of the criteria is satisfied.

Figure 6:
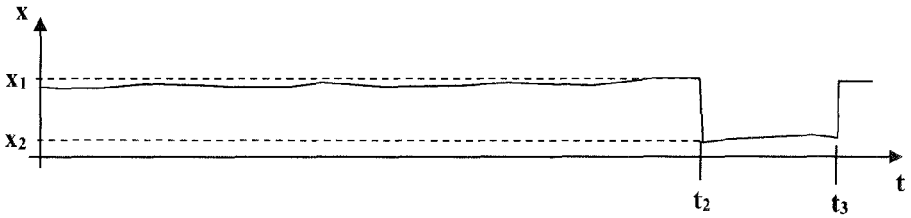
FIG. 6 is a diagram which schematically indicates a possible profile of the quantity of fuel supplied over time.
Figure 7:
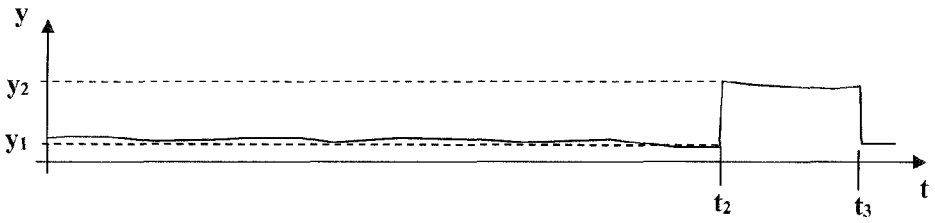
FIG. 7 is a diagram which schematically indicates a possible profile of the quantity of air/fuel mixture supplied over time.

Instead of adjusting the ignition time ZZP, provision may also be made to change the quantity of fuel (x) supplied to the combustion engine 8. This is shown schematically in FIG. 6. At the time $t_2$, the quantity of fuel (x) supplied to the combustion engine 8 is changed from a first quantity of fuel $x_1$ to a second quantity of fuel $x_2$. In the embodiment shown, the supplied quantity of fuel (x) is reduced. The power P of the combustion engine 8 is also increased by reducing the quantity of fuel (x) supplied. The resulting profile of the power P corresponds to the profile shown in FIG. 8 by a dashed line 45 from the time $t_2$ to the time $t_3$. However, provision can also be made to increase the quantity of fuel (x) supplied in order to increase the power P if the combustion engine 8 is operated with a lean mix. In order to increase the power P, provision may also be made to change, preferably to increase, the quantity (y) of fuel/air mixture supplied to the combustion engine 8. This is shown schematically in FIG. 7. At the time $t_2$, the quantity (y) of fuel/air mixture supplied to the combustion engine 8 is changed, increased in the embodiment shown, from a first quantity $y_1$ to a second quantity $y_2$. The profile of the power P that is shown by a dashed line 45 in FIG. 8 from the time $t_2$ to the time $t_3$ is then also produced.

In order to increase the power provided by the combustion engine 8 for driving the saw chain 7, provision can also be made to switch off at least one additional consumer of the motor-driven chain saw 1 or to reduce the energy supplied to the consumer. For example, provision can be made to switch off the oil pump 25. This is indicated schematically in FIG. 2 by the arrow 27. For example, the oil pump 25 can be disengaged from the drive pinion 26 or the output part 44. Alternatively, the stroke of the oil pump 25 can be set to zero. In order to reduce the energy supplied to the oil pump 25, the stroke of the oil pump 25 can be reduced so as to reduce the delivery. Alternatively or in addition, the energy provided to the generator 22 can be reduced.

In order to increase the power available for driving the saw chain 7, provision may also be made additionally to use the drive motor 48 of the starter 23 for driving the saw chain 7. The drive motor 48 can exert an additional driving torque on the crankshaft 19 via the coupling device 49. As a result, a significant increase in power can be achieved. The increased power can be, for example, approximately 150% to approximately 250% of the operating power. The drive motor 48 is advantageously battery-operated. For example, the drive motor can be supplied with energy by approximately five lithium-ion storage batteries. The storage batteries can be charged by the combustion engine 8 during operation. With a drive motor 48 of this type, it is possible, for example, to generate an additional torque of the order of magnitude of approximately 1 Nm. In order to avoid excessive heating of the drive motor 48, it is provided that the predetermined time, after which the power is reset again to the operating power, is up to approximately 10 s. The predetermined time is advantageously at least approximately 5 s.

In order to increase the power of the combustion engine 8, provision may also be made to change the quantity of combustion air supplied to the combustion engine 8, for example by adjusting the end stop 38 into the position shown by dashed lines in FIG. 3. As a result, the quantity of combustion air supplied to the combustion engine 8 is increased, that is, the mixture supplied to the combustion engine 8 is made lean. This produces an increase in the power.

It can also be advantageous to combine a plurality of measures for increasing the power P output by the combustion engine 8 for driving the saw chain 7. The measures mentioned for increasing the power P can be used in each case by themselves or in any combination for increasing the power P of the combustion engine 8.

Figure 9:
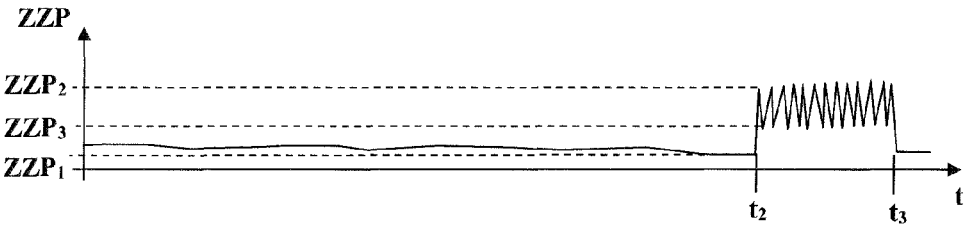

In order to assist breaking a tool loose from a cut, provision may be made, after the increase in the power, to reduce the power P of the combustion engine 8 again and to increase it again. In particular, provision may be made to increase the power P in an alternating manner. This is shown schematically in FIG. 9 for the ignition time ZZP. The ignition time is first of all adjusted from the ignition time $ZZP_1$ to an earlier ignition time $ZZP_2$ and subsequently to a somewhat later ignition time $ZZP_3$ in order then to be adjusted as far as the third time $t_3$ between the ignition times $ZZP_2$ and $ZZP_3$. This results in a zigzag-shaped profile of the ignition time point as a function of time. A corresponding zigzag-shaped profile is produced for the power P of the combustion engine 8, as shown schematically by the line 46 in FIG. 8. Provision may also be made to adjust the power between the first power $P_1$ and the second power $P_2$. This arises by adjusting the ignition time point between the first ignition time point $ZZP_1$ and the second ignition point $ZZP_2$. If the ignition time point is set to the third ignition time point $ZZP_3$ which lies between the first ignition time point $ZZP_1$ and the second ignition time point $ZZP_2$, a third power $P_3$ lying between the operating power $P_1$ and the increased power $P_2$ is produced. A wave-shaped profile of the power P and of the ignition time point ZZP or an abrupt change between two ignition time points and therefore between two power levels may also be advantageous.

In order to increase the power P of the combustion engine 8, the operator can also actuate the operating element 15. The operation of the operating element 15 brings about an increase in the operating power $P_1$ to an increased power $P_2$ or $P_3$. The increased power can be maintained for a predetermined period of time or until a predetermined, increased temperature of the combustion engine 8 is reached, in order then to be reset to the operating power $P_1$. If the increased power ($P_2$, $P_3$) is of such a low level that it is suitable for continuous operation, provision may also be made to reset the power to the operating power $P_1$ again only when the operator releases the operating element 15.

It is understood that the foregoing description is that of the preferred embodiments of the invention and that various changes and modifications may be made thereto without departing from the spirit and scope of the invention as defined in the appended claims.

What is claimed is:

1. A method for operating a handheld work apparatus which includes a centrifugal clutch, a work tool and a combustion engine for driving said work tool via said centrifugal clutch, said centrifugal clutch defining a coupling engaging rotational speed range ($n_K$) wherein said centrifugal clutch engages and said coupling engaging range extends between a lower coupling engaging rotational speed ($n_u$) and an upper coupling engaging rotational speed ($n_o$); said combustion engine including a fuel metering device, an ignition device, a control unit, a throttle lever, and a device for detecting the rotational speed (n) of said combustion engine, the method comprising the steps of:

monitoring the rotational speed profile of said combustion engine in said coupling engaging rotational speed range ($n_K$); and, when the throttle lever is fully actuated, increasing the power (P) delivered to drive said work tool from an operating power ($P_1$) to an increased power ($P_2$, $P_3$) when said rotational speed profile corresponds to a pregiven rotational speed profile over a pregiven time span ($\Delta t$) and when the rotational speed (n) is below the upper coupling engaging rotational speed ($n_o$).

2. The method of claim 1, wherein said pregiven time span ($\Delta t$) is at least 0.1 s.

3. The method of claim 1, wherein said increased power ($P_2$, $P_3$) is at least 103% of said operating power ($P_1$).

4. The method of claim 1, wherein said power (P) is increased in a discontinuous jump.

5. The method of claim 1, wherein after the power increase, said power (P) is reduced at least once and again increased.

6. The method of claim 1, wherein said power (P) is set back to said operating power ($P_1$) when said rotational speed (n) leaves said coupling engaging rotational speed range ($n_K$).

7. The method of claim 1, wherein said power (P) is set back to said operating power ($P_1$) after the elapse of a pregiven time ($\Delta t_2$).

8. The method of claim 1, wherein said power (P) is set back to said operating power ($P_1$) after reaching a pregiven temperature of said combustion engine.

9. The method of claim 1, wherein said power (P) delivered by said combustion engine is increased by shifting the ignition time point (ZZP) of said combustion engine.

10. The method of claim 1, wherein said power (P) delivered by said combustion engine is increased by changing the metered fuel quantity (x).

11. The method of claim 1, wherein said power (P) delivered by said combustion engine is increased by changing the quantity of combustion air supplied to said combustion engine.

12. The method of claim 1, wherein said power (P) delivered by said combustion engine is increased by changing the quantity (y) of air/fuel mixture supplied to said combustion engine.

13. The method of claim 1, wherein, in addition to said work tool, said handheld work apparatus includes at least one additional consumer of energy which said combustion engine supplies with energy.

14. The method of claim 13, wherein said power (P) is increased by switching off said at least one additional consumer of energy.

15. The method of claim 13, wherein said power (P) is increased by reducing the energy supplied to said at least one additional consumer of energy.

16. The method of claim 1, wherein said work apparatus further includes an operator-controlled element and said power (P) of said combustion engine is increased when said operator-controlled element is actuated.

17. A method for operating a handheld work apparatus which includes a centrifugal clutch, a work tool and a combustion engine for driving said work tool via said centrifugal clutch, said centrifugal clutch defining a coupling engaging rotational speed range ($n_K$) wherein said centrifugal clutch engages and said coupling engaging range extends between a lower coupling engaging rotational speed ($n_u$) and an upper coupling engaging rotational speed ($n_o$);

said combustion engine including a fuel metering device, an ignition device, a control unit and a device for detecting the rotational speed (n) of said combustion engine, the method comprising the steps of:

monitoring the rotational speed profile of said combustion engine in said coupling engaging rotational speed range ($n_K$); and, increasing the power (P) delivered to drive said work tool from an operating power ($P_1$) to an increased power ($P_2$, $P_3$) when said rotational speed profile corresponds to a pregiven rotational speed profile over a pregiven time span ($\Delta t$), wherein said pregiven rotational speed profile is a constant rotational speed ($n_1$).

18. A method for operating a handheld work apparatus which includes a centrifugal clutch, a work tool and a combustion engine for driving said work tool via said centrifugal clutch, said centrifugal clutch defining a coupling engaging rotational speed range ($n_K$) wherein said centrifugal clutch engages and said coupling engaging range extends between a lower coupling engaging rotational speed ($n_u$) and an upper coupling engaging rotational speed ($n_o$); said combustion engine including a fuel metering device, an ignition device, a control unit and a device for detecting the rotational speed (n) of said combustion engine, the method comprising the steps of:

monitoring the rotational speed profile of said combustion engine in said coupling engaging rotational speed range ($n_K$); and, increasing the power (P) delivered to drive said work tool from an operating power ($P_1$) to an increased power ($P_2$, $P_3$) when said rotational speed profile corresponds to a pregiven rotational speed profile over a pregiven time span ($\Delta t$), wherein said handheld work apparatus has an additional drive motor and said power (P) is increased by switching in said additional drive motor.

* * * * *